US006553202B2

(12) United States Patent
Tamaki et al.

(10) Patent No.: US 6,553,202 B2
(45) Date of Patent: Apr. 22, 2003

(54) METHOD AND APPARATUS FOR IMAGE FORMING CAPABLE OF PERFORMING AN EFFECTIVE DEVELOPMENT PROCESS

(75) Inventors: Shinji Tamaki, Tokyo (JP); Hideo Yoshizawa, Saitama-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/903,589

(22) Filed: Jul. 13, 2001

(65) Prior Publication Data

US 2002/0021919 A1 Feb. 21, 2002

(30) Foreign Application Priority Data

Jul. 13, 2000 (JP) ..... 2000-212495

(51) Int. Cl.[7] ..... G03G 15/08
(52) U.S. Cl. ..... 399/258; 399/103; 399/263
(58) Field of Search ..... 399/258, 259, 399/262, 263, 103, 119

(56) References Cited

U.S. PATENT DOCUMENTS

| | | | | |
|---|---|---|---|---|
| 4,937,628 A | * | 6/1990 | Cipolla et al. | 399/262 X |
| 5,028,961 A | * | 7/1991 | DeCecca | 399/258 X |
| 5,121,165 A | * | 6/1992 | Yoshida et al. | 399/119 |
| 5,325,163 A | * | 6/1994 | Nishio | 399/262 X |
| 5,389,732 A | * | 2/1995 | Sekino | 399/103 |
| 5,758,241 A | * | 5/1998 | Oyama et al | 399/259 X |
| 5,765,079 A | | 6/1998 | Yoshiki et al. | 399/258 |
| 5,794,108 A | | 8/1998 | Yoshizawa et al. | 399/262 |
| 5,970,290 A | | 10/1999 | Yoshiki et al. | 399/261 |
| 6,141,521 A | | 10/2000 | Yuuki et al. | 399/270 |
| 6,198,895 B1 | | 3/2001 | Tsuda et al. | 399/267 |
| 6,289,194 B1 | * | 9/2001 | Endo et al. | 399/258 |
| 6,337,957 B1 | * | 1/2002 | Tamaki et al. | 399/258 X |

FOREIGN PATENT DOCUMENTS

| | | |
|---|---|---|
| JP | 9-197833 | 7/1997 |
| JP | 2000-131929 | 5/2000 |
| JP | 2000-250296 | 9/2000 |

* cited by examiner

*Primary Examiner*—Fred L Braun
(74) *Attorney, Agent, or Firm*—Oblon, Spivak, McClelland, Maier & Neustadt, P.C.

(57) ABSTRACT

An apparatus including a development agent carrying member, a toner container having an opening, an initial development agent container, a flexible member, and a stopper. The flexible member rotates to cyclically transfer toner to the carrying member via the opening. The stopper locates the flexible member at a closed position where the opening is closed. The flexible member is initially located at the closed position and releases the opening when the development agent is present on a surface of the carrying member facing the opening. A method of image forming is provided that includes sealing the opening by engaging the flexible member with the stopper, filling the toner container, supplying a development agent to the carrying member at a surface of the development agent facing the opening, and releasing the opening to start supplying the toner to the carrying member through the opening by rotation of the flexible member.

28 Claims, 8 Drawing Sheets

METHOD AND APPARATUS FOR IMAGE FORMING CAPABLE OF PERFORMING AN EFFECTIVE DEVELOPMENT PROCESS

BACKGROUND OF THE INVENTION

1. Field of the Invention

The present invention relates to a method and apparatus for image forming, and more particularly to a method and apparatus for image forming that is capable of performing an effective development process.

2. Description of the Related Art

In a background image forming apparatus such as a copying machine, a facsimile machine, a printer, and so forth, an image forming operation is typically performed by an electrophotographic method that includes various sequential processes. The sequential processes include forming an electrostatic latent image on an image carrying member, developing the latent image with toner into a visual toner image, transferring the toner image on a recording sheet, and fixing the image.

In a two-component development method using a two-component development agent including toner particles and magnetic carriers, the toner particles are charged by friction charge generated between the toner particles and magnetic carriers. The toner particles are captured by the magnetic carriers which are carried by a development agent carrying member because the development agent includes an inner magnet. The development agent is transferred to a development position facing an image carrying member by the development agent carrying member. At the development position, the toner captured by the magnetic carriers is transferred by an electrostatic force to the electrostatic latent image formed on the surface of the image carrying member. Thereby, the image is developed into a visual toner image.

After consuming the toner in the development process, the two-component development agent is carried to a position at which it is.supplied with toner so that the sequential development process can be performed with the two-component development agent containing a sufficient amount of toner. In a development apparatus using such a two-component type development agent, it is necessary to maintain a constant ratio of toner particles to magnetic carriers so as to obtain a stable image density.

For example, a published Japanese unexamined patent application, No. 9-197833 (1997), describes a development apparatus using a two-component development agent. In this development apparatus, a development agent is carried by a development agent carrying member and is supplied with toner from a toner container. When the development agent consumes toner in a development process, the development agent is moved on the development agent carrying member such as to capture toner in accordance with variations in toner density. This development apparatus eliminates the need for a toner density control mechanism including a toner density sensor and so on and therefore it is superior in downsizing and a cost reduction situations.

Generally, it is desirable that a machine separate development agent and toner from each other in respective sealed packages until the user starts to use the machine for the first time after delivery from a manufacturing site, wherein the development agent is adjusted to initially include magnetic carriers with toner at a predetermined toner density or including magnetic carriers only. This is to prevent undesirable dispersion and mixture of the adjusted development agent and the toner.

In one exemplary development apparatus, both containers for the development agent and the toner have openings connected to the development agent carrying member. Each of the openings is initially sealed with a sealing member and is removed when the development apparatus is used. With this structure, the adjusted development agent is initially supplied to the development agent carrying member by removing the sealing member fixed to the container for the development agent and the toner is initially supplied to the development agent carried on the development agent carrying member by removing the sealing member fixed to the container for the toner. However, when both sealing members are removed at the same time or when the sealing member for the toner container is removed earlier than the other, the toner may be supplied to the surface of the development agent carrying member where the development agent is not carried on. Even if the sealing member for the development agent container is first removed, the toner may also be supplied to the surface of the development agent carrying member where the development agent is not carried on when the development agent carrying member is not started. When the toner is directly attached to the surface of the development agent carrying member where the development agent is not present, it is possible that the toner density in an area of the surface is dense and, as a result, an abnormal image such as a dirty background is reproduced, particularly, upon initial use of the machine.

In an attempt to solve the above-described problem, a background development apparatus was developed having a structure in which the opening for the toner is released after the development agent is deposited on a surface of the development agent carrying member facing the opening where the toner is supplied. In this apparatus, the toner supply from the toner container through the opening to the development agent carrying member is prevented with a sealing member, provided near the opening, until the development agent is deposited on a surface of the development agent carrying member in turn facing the opening where the toner is supplied. The sealing member is moved to release the opening after the development agent is deposited on a surface of the development agent carrying member in turn facing the opening where the toner is supplied, and supply of the toner is consequently started relative to the development agent carried on the development agent carrying member. The above-described background development apparatus has a structure in which a single member made of a flexible material is used as a rotary member for transferring the toner contained in the toner container by its rotation and is also used as a sealing member for sealing the opening of the toner container.

FIG. 1 depicts a structure of a background development apparatus 200. In the background development apparatus 200, a toner agitator 229 includes a rotary member 229*c* configured to hold a flexible member 229*a* which is located at a position where it closes a toner opening 228*a* formed in a toner container 228. When the flexible member 229*a* is rotated, supply of toner T contained in the toner container 228 is started through the opening 228*a* relative to a development agent 223 carried on a development agent carrying member 224. However, the background development apparatus is disadvantageously configured such that it is difficult to completely close the opening 228*a* with the flexible member 229*a*. In this configuration, the opening 228*a* is closed and sealed shut only by pressure on the flexible member 229*a* caused by the weight of the toner T contained in the toner container acting against the flexible member 229*a*.

SUMMARY OF THE INVENTION

The present invention provides a novel development apparatus. In one example, a novel development apparatus includes a development agent carrying member, a toner container, an initial development agent container, a flexible feather-like member, and a stopper. The development agent carrying member is configured to carry and transport a development agent including toner and magnetic carriers, and includes an inner magnetic field generating mechanism. The toner container is configured to contain toner, and includes an opening through which the toner is supplied to the development agent carrying member. The opening is located at a position facing the development agent carrying member. The initial development agent container is configured to contain an initial development agent including at least magnetic carriers and to be sealed when the apparatus is in an initially unused condition. The initial development agent container includes a mechanism for supply the initial development agent to the development agent carrying member when the apparatus is initially used. The flexible feather-like member is arranged inside the toner container near the opening and is configured to rotate to cyclically transfer the toner to the development agent carrying member via the opening. The stopper is configured to be mounted to inner and bottom surface of the toner container at a stop position such that the stopper is engaged with a top edge of the flexible feather-like member to locate the flexible feather-like member at a closed position where the opening is closed by the flexible feather-like member. In this development apparatus, the flexible feather-like member is initially located at the closed position and is caused to release the opening when the development agent is present on a surface of the development agent carrying member which in turn faces the opening after the development agent carrying member begins rotating.

The above-described development apparatus may further include a holding mechanism configured to hold the flexible feather-like member at the closed position.

The holding mechanism can have a function for transmitting rotation of the development agent carrying member to the flexible feather-like member or rotation of the flexible feather-like member to the development agent carrying member.

The above-described development apparatus can further include an elastic member fixed to a circumferential edge of the opening of the toner container, where the flexible feather-like member contacts.

The flexible feather-like member can be flexible enough to bend, under pressure from the toner when rotating, to an extent such as not to touch an inner surface of the toner container when the toner container contains more than a predetermined amount of the toner.

The toner supplied through the opening of the toner container can be captured by the development agent carried on the development agent carrying member in accordance with a toner density of the development agent carried on the development agent carrying member.

The present invention describes another novel development apparatus. In one example, another novel development apparatus includes a development agent carrying member, a toner container, a flexible feather-like member, and a stopper. The development agent carrying member is configured to carry a development agent. The toner container is configured to contain toner and includes an opening through which the toner is supplied to the development agent carrying member. The opening is located at a position facing the development agent carrying member. The flexible feather-like member is arranged inside the toner container near the opening and is configured to rotate to cyclically transfer the toner to the development agent carrying member via the opening. The stopper is configured to be mounted to inner and bottom surface of the toner container at a stop position such that the stopper is engaged with a top edge of the flexible feather-like member to locate the flexible feather-like member at a closed position where the opening is closed by the flexible feather-like member.

Additionally, the present invention describes a novel image forming apparatus. In one example, a novel image forming apparatus includes a development apparatus that has a development agent carrying member, a toner container, a flexible feather-like member, and a stopper. The development agent carrying member is configured to carry a development agent. The toner container is configured to contain toner and includes an opening through which the toner is supplied to the development agent carrying member. The opening is located at a position facing the development agent carrying member. The flexible feather-like member is arranged inside the toner container near the opening and is configured to rotate to cyclically transfer the toner to the development agent carrying member via the opening. The stopper is mounted to inner and bottom surfaces of the toner container at a stop position such that the stopper is engaged with a top edge of the flexible feather-like member to locate the flexible feather-like member at a closed position where the opening is closed by the flexible feather-like member.

Furthermore, the present invention describes a novel method of image forming. In one example, a novel method includes the steps of sealing, filling, supplying, and releasing. The sealing step seals an opening of a toner container for containing toner by engaging a flexible feather-like member with a stopper. The filling step fills the toner into the toner container. The supplying step supplies a development agent including at least magnetic carriers to a development agent carrying member at a surface of the development agent facing the opening of the toner container. The releasing step releases the opening to start supplying of the toner to the development agent carrying member through the opening by rotation of the flexible feather-like member.

The above-described novel method can further include a holding step for holding the flexible feather-like member at the closed position.

The development agent carrying member can be transmitted to the flexible feather-like member or a movement of the flexible feather-like member is transmitted to the development agent carrying member.

The above-described novel method can further include a step of fixing an elastic member to a circumferential edge of the opening of the toner containing member, where the flexible feather-like member contacts.

The flexible feather-like member can be flexible enough to bend, under pressure from the toner when moving, to an extent such as not to touch an inner surface of the toner container when the toner container contains more than a predetermined amount of the toner.

The toner supplied through the opening of the toner container can be captured by the development agent carried on the development agent carrying member in accordance with a toner density of the development agent carried on the development agent carrying member.

The releasing step can include the steps of turning the flexible feather-like member, causing the flexible feather-like member to be lifted up by the stopper, lowering the flexible feather-like member from the stopper, reversing the flexible feather-like member by a predetermined angular degree to engage with the stopper, and applying a reversing force to the flexible feather-like member for turning the flexible feather-like member by another predetermined angular degree.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
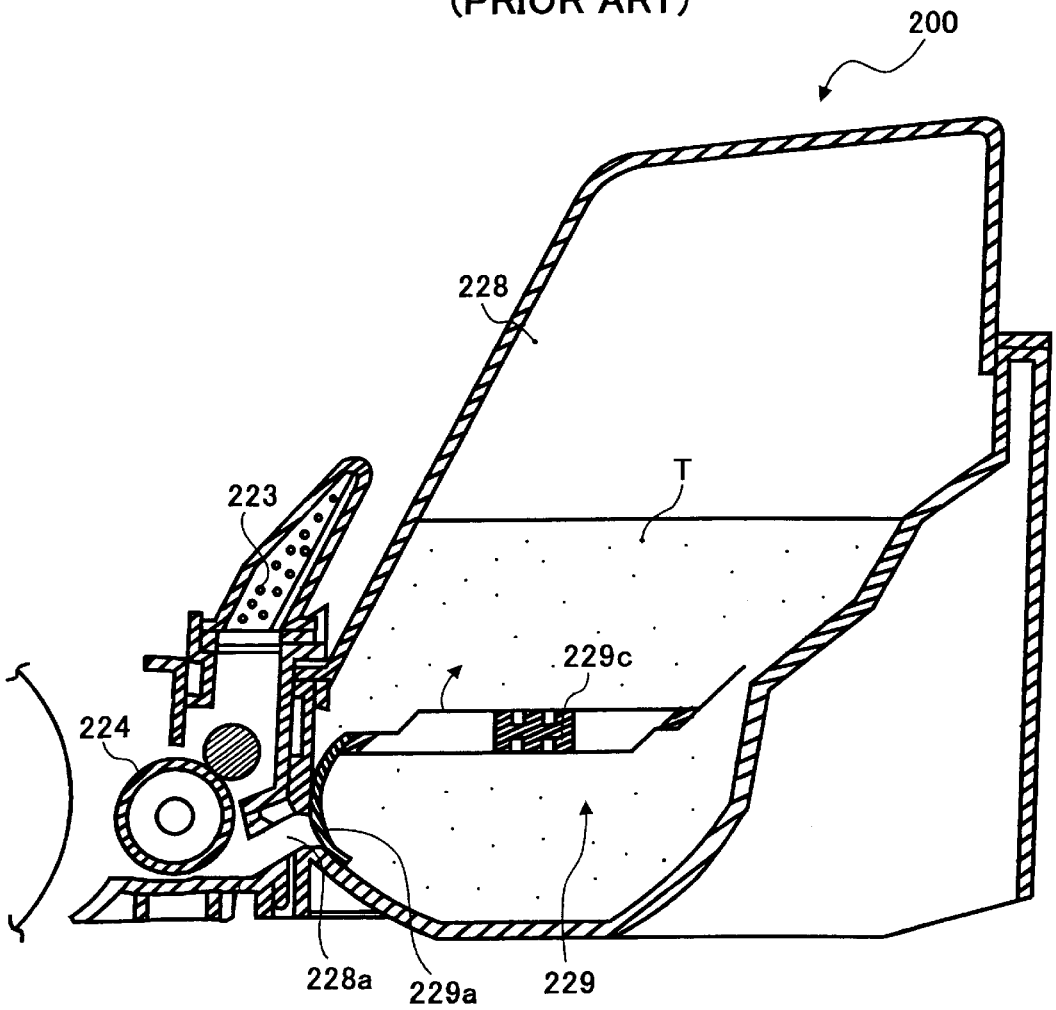
FIG. 1 (PRIOR ART)
FIG. 1 is a schematic diagram of a background development apparatus.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Figure 2:
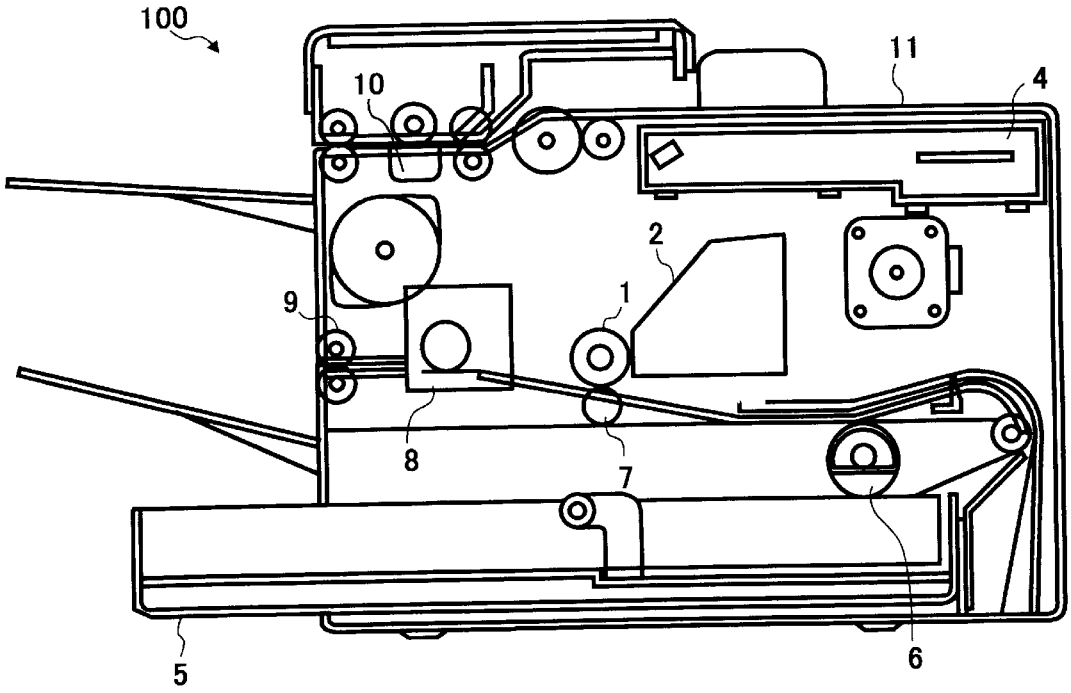
FIG. 2 is a schematic diagram of an image forming apparatus including a development apparatus according to an embodiment of the present invention.

Referring now to the drawings, wherein like reference numerals designate identical or corresponding parts throughout the several views, and more particularly to FIG. 2 thereof, an electrophotographic digital copying apparatus 100 according to an embodiment of the present invention is explained below. As depicted in FIG. 2, the digital copying apparatus 100 includes a photoconductive drum 1, a development unit 2, an optical writing unit 4, a sheet cassette 5, a sheet feed roller 6, a transfer roller 7, a fixing unit 8, an ejection roller 9, a sensor 10, and a document bed 11.

The development unit 2 performs an image forming according to an electrophotographic process relative to the photoconductive drum 1 and is detachably mounted in the digital copying apparatus 100. The optical writing unit 4 scans the photoconductive drum 1 with laser light modulated in accordance with image data. The sheet cassette 5 contains recording sheets. The sheet feed roller 6 feeds a recording sheet to a sheet passage guiding the recording sheet to the photoconductive drum 1. The transfer roller 7 contacts the photoconductive drum 1 and transfers a toner image formed on the photoconductive drum 1 onto the recording sheet. The fixing unit 8 fixes the toner image on the recording sheet. The ejection roller 9 ejects the recording sheet having a fixed toner image outside the digital copying apparatus 100. The sensor 10 is a close-contact type sensor and reads an image of a document sheet. The document bed 11 has an upper surface on which a document sheet is placed facedown when it is read for copying.

A document sheet placed on the document bed 11 is transferred with a sheet transferring mechanism (not shown), passing by the sensor 10, and is ejected outside the digital copying apparatus 100. During a time when the document sheet passes by the sensor 10, the sensor 10 optically reads an image of the document sheet and generates image data accordingly. The image data generated by the sensor 10 is sent to the optical writing unit 4 which modulates laser light in accordance with the image data and irradiates the modulated laser light on the surface of the photoconductive drum 1 which is evenly charged. Thereby, an electrostatic latent image is formed on the photoconductive drum 1. Image data can be input from an external data source (i.e., a personal computer) as an alternative to the image data read with the sensor 10. The electrostatic latent image formed on the photoconductive drum 1 is developed with toner into a toner image as a visual image. The toner image is transferred with the transfer roller 7 onto a recording sheet. The recording sheet having the toner image is then transported to the fixing unit 8 which applies pressure and heat to the recording sheet so that the toner image is fixed on the recording sheet. After that, the recording sheet is ejected by the ejection roller 9 outside the digital copying apparatus 100.

Figure 3:
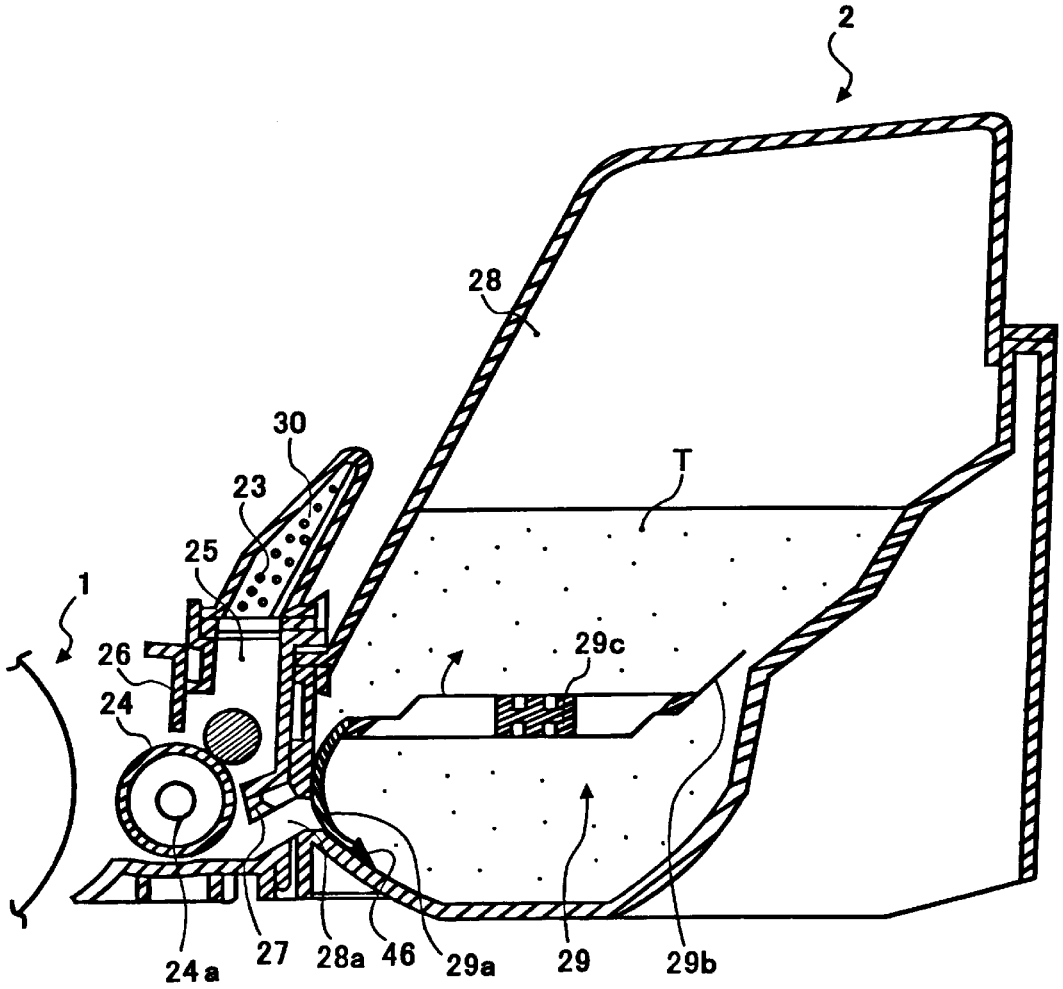
FIG. 3 is a schematic diagram of the development apparatus included in the image forming apparatus of FIG. 2.

Referring to FIG. 3, the development unit 2 of the digital copying apparatus 100 is explained below. In FIG. 3, the photoconductive drum 1 that serves as an image carrying member is clockwise rotated by a driving mechanism (not shown) and forms an electrostatic latent image on the surface thereof through an electrophotographic process which is known.

The development unit 2 includes a development sleeve 24, a development agent container 25, a first regulating member 26, a second regulating member 27, and a toner hopper 28.

The development sleeve 24 carries on its surface two-component type development agent 23 including toner T and magnetic carrier (not shown), and is driven to rotate counterclockwise. The development sleeve 24 includes a magnet roller 24*a* (i.e., an inner magnetic field generating mechanism) which generates a magnet force attracting the development agent 23 to the surface of the development sleeve 24. The magnet roller of the development sleeve 24 is fixed so as not to rotate with the rotation of the development sleeve 24. The first regulating member 26 is arranged at a position over the development sleeve 24 with a predetermined distance (hereinafter referred to as a first regulating gap) relative to the surface of the development sleeve 24 so that the development agent 23 carried on the rotating surface of the development sleeve 24 is regulated into a thin layer.

The second regulating member 27 is arranged at a position about a quarter of a turn (about 90 degrees) upstream from the first regulating member 26 in the rotation direction with a predetermined distance (hereinafter referred to as a second regulating gap) relative to the surface of the development sleeve 24. The second regulating gap is greater than the first regulating gap so that the second regulating member 27 regulates the development agent 23 into a layer thicker than that formed by the first regulating member 26.

The first and second regulating members 26 and 27 are configured to be portions of the development agent container 25 that stores the development agent 23 which is blocked by the first regulating member 26 and stays before the first regulating member 26. The magnet force emitted from the magnet roller of the development sleeve 24 extends within the inside the development agent container 25.

The toner hopper 28 is arranged at a position above and to the right of the development sleeve 24, as viewed in FIG. 3, and stores the development agent 23 inside thereof. The toner hopper 28 includes an opening 28*a* arranged at a position close to the development sleeve 24, and a toner agitator 29 is provided inside the toner hopper 28 at a position close to the opening 28*a*. The toner agitator 29 is rotated within new toner contained in the toner hopper 28 and sends the new toner to the development sleeve 24 through the opening 28*a*.

The toner agitator 29 includes feather-like portions 29*a* and 29*b* each made of a flexible member. The toner agitator 29 further includes a rotating member 29*c* for rotating the feather-like portions 29*a* and 29*b*. When the development unit 2 is new and has not yet been used, the feather-like portion 29*a* is located at a position closing the opening 28*a*, as depicted in FIG. 3. However, when the development unit 2 is used, the feather-like portion 29*a* releases the opening 28*a* as the toner agitator 29 is rotated and the feather-like portion 29*a* is stopped at a different position so as not to close the opening, as shown in FIG. 4.

The toner T included in the development agent 23 has magnetic properties and has a particle diameter in a range of from 4 $\mu$m to 15 $\mu$m The magnetic carrier included in the development agent 23 has a property of low resistance and has a particle diameter in a range of from 20 $\mu$m to 50 $\mu$m. The toner density inside the development agent container 25 is controlled such that a covering ratio of the magnetic carrier surfaces with depositions of the toner particles is maintained as a value of approximately 100%.

Figure 4:
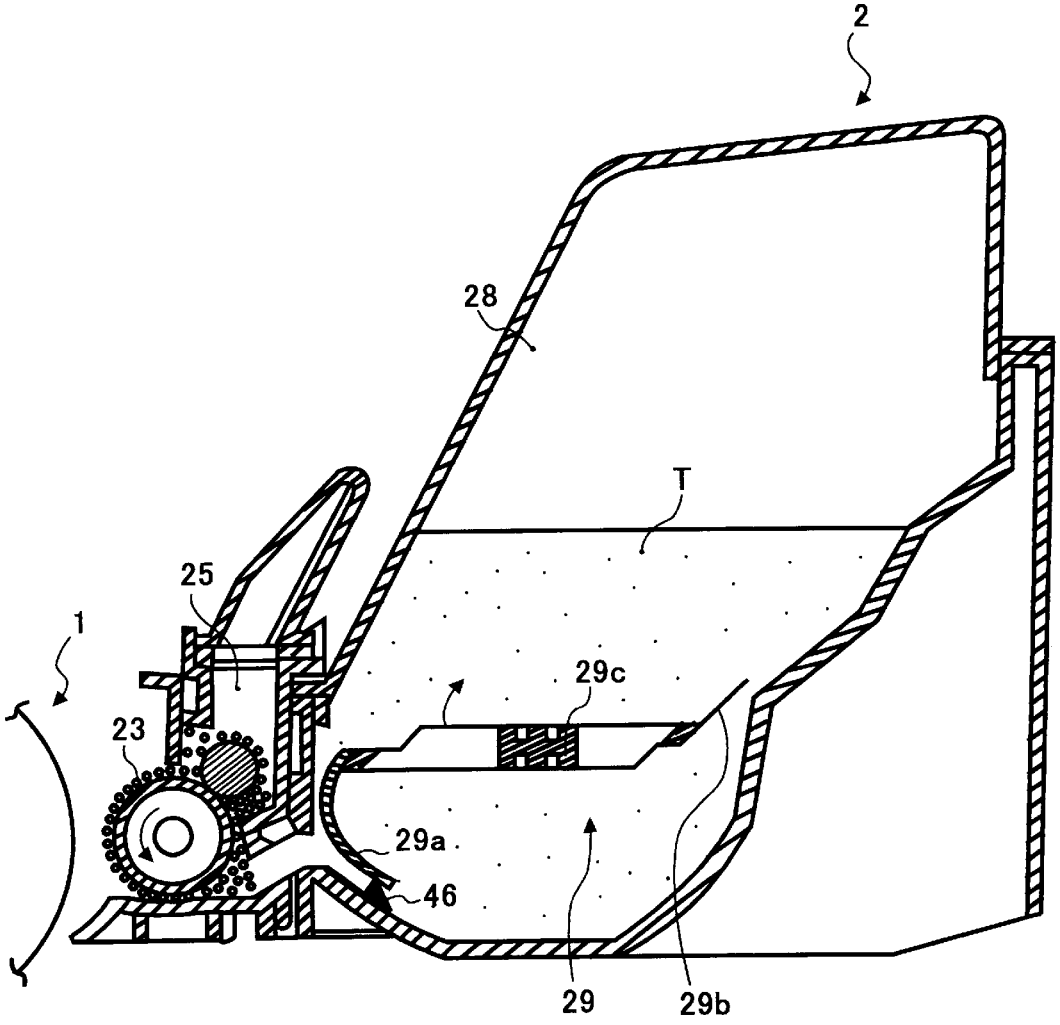
FIG. 4 is a schematic diagram for explaining a release of an opening in a toner hopper provided to the development apparatus of FIG. 2.

In FIG. 4, the development agent 23 carried by the development sleeve 24 is transported to the first regulating member 26 and is regulated by the first regulating member 26 into a thin layer. The development agent 23 in the thin layer is brought to a development position facing the photoconductive drum 1. The development sleeve 24 is applied with a development bias by a power source (not shown) to generate a development potential at the development position between the electrostatic latent image formed on the photoconductive drum 1 and the surface of the development sleeve 24. The development potential produces an electrostatic force that moves the charged toner T from the development sleeve 24 to the photoconductive drum 1. Thereby, the electrostatic latent image is developed into a visible toner image. The magnet of the toner T is determined such that the electrostatic force generated by the development potential is greater than the magnetic attaching force of the toner T caused by the magnetic force of the magnet roller of the development sleeve 24. In the development unit 2, the toner T is provided with magnetic properties in order also to avoid dispersion of toner particles inside the printer apparatus.

The development agent 23 thus consuming the toner T is further carried by the development sleeve 24 to a toner supply position facing the opening 28*a* of the toner hopper 28. At the toner supply position, the toner T is supplied from the toner hopper 28 to the surface of the development sleeve 24 via the opening 28*a*. While the development agent 23 carried on the development sleeve 24 is moved towards the second regulating member 27 by the rotation of the development sleeve 24, the toner T is captured by the development agent 23 and enters inside the layer of the development agent 23. As a result, the layer of the development agent 23 increases in height (i.e., thickness). Thereafter, the layer of the development agent 23 is regulated by the second regulating member 27. Then, the development agent 23 is moved to a position facing the development agent container 25 and is then regulated by the first regulating member 26 into a thin layer. During this regulation process, an inner pressure present inside the development agent 23 is increased so that the toner T is caused to rub against the magnetic carriers and acquire/retain a charge. After that, the development agent 23 is carried to the.above-described development position.

During the layer regulation process, a part or portion of the development agent 23 is rejected and is held within an area before the first regulating member 26. The rejected part of the development agent 23 moves, by its own weight and an inner pressure, in a direction opposite to the rotation direction of the development sleeve 24 such that it reaches the second regulating member 27. After contacting the second regulating member 27, the rejected part of the development agent 23 is carried by the development sleeve 24 to the first regulating member 26. Thereby, the rejected part of the development agent 23 is circulated. By the repetition of this circulation, the development agent 23 contained in the development agent container 25 is circulated.

The toner density of the development agent 23 carried by the development sleeve 24 is reduced as the development process is performed and an amount of the development agent 23 is reduced. Consequently, an amount of the development agent 23 to be regulated by the second regulating member 27 is also reduced. This causes a reduction of the amount of the development agent 23 which is rejected by the second regulating member 27 and is held within an area close to the opening 28*a* of the toner hopper 28. Consequently, the toner T is actively captured by the development agent 23 mainly at a position relatively close to the surface of the development sleeve 24 since the development agent 23 is moved nearly at the rotation speed of the development sleeve 24. When the toner T is actively captured by the development agent 23 in this way, the amount of the toner T captured around the area near the opening 28*a* is greater than that consumed through the development process. Thereby, the toner density of the development agent 23 carried by the development sleeve 24 is gradually increased.

As the toner density is increased, the amount of the development agent 23 is increased, which causes an increase in the toner T rejected by the second regulating member 27 and that is held around the area near the opening 28*a*. Then, the toner T is captured by the development agent 23 mainly at a position relatively away from the surface of the development sleeve 24 where the toner T is not actively captured by the development agent 23 since the development agent 23 is moved at a speed substantially lower than the rotation speed of the development sleeve 24. When the toner T is not actively captured by the development agent 23, the toner amount consumed through the development process is greater than the amount of the toner T captured around the area near the opening 28*a*. Thereby, the toner density of the development, agent 23 carried by the development sleeve 24 is gradually decreased.

In this way, the toner density of the development agent 23 carried on the development sleeve 24 can be maintained within a predetermined range by varying the capturing amount of the toner T in accordance with the toner density of the development agent 23 carried on the development sleeve 24. By controlling the toner density in the above-described way, the development unit 2 can eliminate various components needed for the background development unit, including a toner density sensor, an optical sensor for detecting an amount of toner deposition forming a reference toner image on a photoconductive drum 1, and a toner supply unit.

In the development unit 2 of the present invention, the development agent 23 having a predetermined toner density is initially provided into the development agent container 25. As shown in FIG. 3, the development agent container 25 is provided at an upper portion thereof with an initial development agent container 30 for initially containing the development agent 23. An upper opening of the development agent container 25 and a bottom opening of the initial development agent container 30 are sealed with a common sealing member using heat, for example. This sealing member is removed by pulling, for example, by a user when the printer apparatus is initially used so that the development agent 23 initially contained in the initial development agent container 30 is transferred into the development agent container 25 and to the development sleeve 24.

In the development unit 2, the toner T sealed inside the toner hopper 28 is initially prevented from flowing out through the opening 28*a* using the feather-like portion 29*a* of the toner agitator 29, as described above. The feather-like portion 29*a* is made of flexible member, such as Mylar, a PET (polyethylene terephthalate) film or the like, and is fixed to the tip of the rotating member 29*c*. The feather-like portion 29*a* is initially located at a position closing the opening 28*a* so that the opening 28*a* is closed and the toner T is not flowed out from the toner hopper 28 through the opening 28*a* to the development agent container 25, as depicted in FIG. 3. When the development unit 2 is in operation, the rotating member 29*c* is rotated to agitate the toner T and to transport the toner T to the opening 28*a*. The feather-like portion 29*b* is also fixed to the rotating member 29*c*, and the feather-like portion 29*b* has a length shorter than the feather-like portion 29*a*. The toner agitator 29 can be a single-piece member made of a flexible material, in which the feather-like portions 29*a* and 29*b* and the rotating member 29*c* are integrated, or the toner agitator 29 can be made of several interconnected portions.

As shown in FIG. 3, the toner hopper 28 is provided with a stopper 46 inside thereof. The feather-like portion 29*a* is engaged with the stopper 46 to properly stop at the position for closing the opening 28*a*. The feather-like portion 29*a* closes the opening 28*a* by positioning against the stopper 46 and also by the pressure of the toner T contained in the toner hopper 28.

In the development unit 2, the feather-like portion 29*a* is moved to release the opening 28*a* when the development agent 23 is present on the surface of the development sleeve 24 which in turn faces the opening 28*a* after the development agent 23 is initially released from the initial development agent container 30 to the development sleeve 24. This timing of the movement of the feather-like portion 29*a* can be achieved by transmitting the rotation of the development sleeve 24 to the rotating member 29*c* via a reduction-gear mechanism and driving the development sleeve 24 at a greater number of revolutions than the rotating member 29*c*. With this arrangement, the rotating member 29*c* is started to rotate nearly at the same time as when the development sleeve 24 is caused to start its rotation after having the development agent 23 on its surface, but the rotating member 29*c* is moved at a speed lower than that of the development sleeve 24 due to the reduction gear mechanism. The rotating member 29*c* therefore causes the feather-like portion 29*a* to move away from the closed position at the opening 28*a* at a slower speed relative to the speed that the development sleeve 24 moves. That is, the numbers of revolutions per unit time for the development sleeve 24 and the rotating member 29*c* are determined such that the feather-like portion 29*a* is caused to start moving away from the closed position at the opening 28*a* so as to release the opening 28*a* after the development agent 23 is present on the surface of the development sleeve 24 which in turn faces the opening 28*a*. An appropriate number of revolutions per unit time for the development sleeve 24 is determined according mainly to an outer diameter thereof. An appropriate number of revolutions per unit time for the rotating member 29*c* is determined according mainly to a contour thereof, a material used, and a size of the opening 28*a*. Therefore, appropriate numbers of revolutions per unit time are to be studied through experiments and are determined for use.

In the development unit 2, the number of revolutions per unit time for the rotating member 29*c* is defined to be equal to one-eighth of that for the development sleeve 24. With this arrangement, the feather-like portion 29*a* can be held at the closed position until the development agent 23 is present on the surface of the development sleeve 24 which in turn faces the opening 28*a*. Further, the feather-like portion 29*a* is started to move from the position to close the opening 28*a* so as to release the opening 28*a* after the development agent 23 is present on the surface of the development sleeve 24 which in turn faces the opening 28*a*.

The number of revolutions per unit time for the rotating member 29*c* can be made equal to one-eighth of that for the development sleeve 24 by arranging the reduction ratio of the reduction gear mechanism to eight to one.

Figure 5:
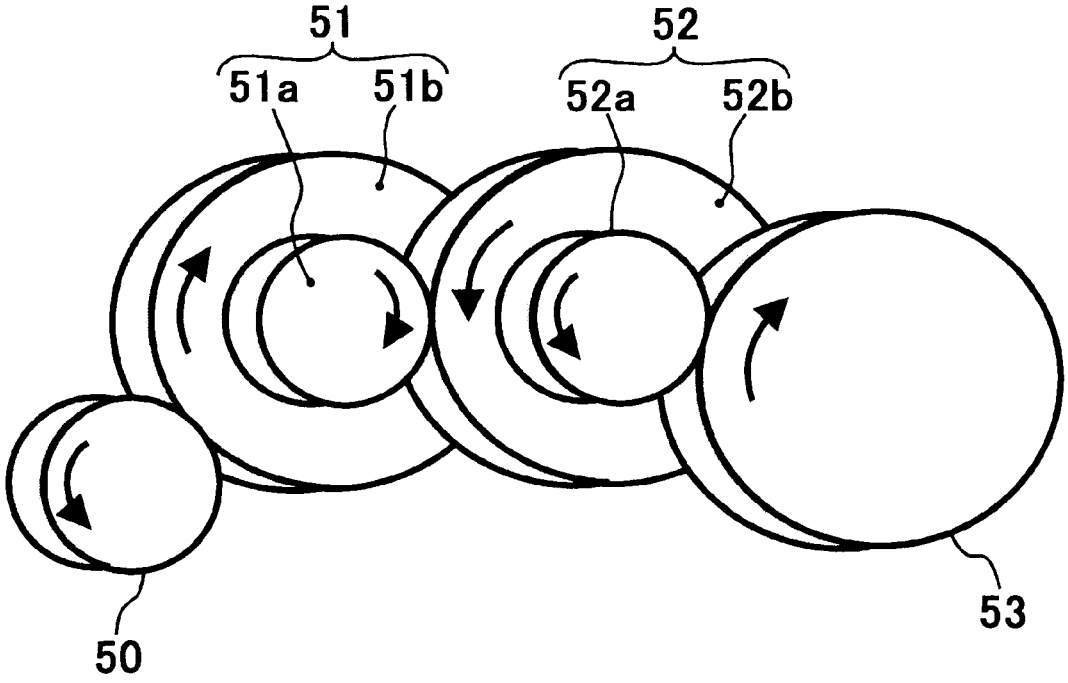
FIG. 5 a schematic diagram of a reduction gear mechanism included in the image forming apparatus of FIG. 2.

One example of the above-described reduction gear mechanism is schematically depicted in FIG. 5. The reduction gear mechanism of FIG. 5 has a ratio of eight to one and includes a first driving gear 50, a first two-stage gear 51, a second two-stage gear 52, and a second driving gear 53. The first driving gear 50 has sixteen teeth and is fixed to the rotation shaft of the development sleeve 24 so as to drive the development sleeve 24. The first two-stage gear 51 includes a gear 51 a having sixteen teeth and a gear 51*b* having thirty-two teeth, both having a common rotating shaft. The second two-stage gear 52 includes a gear 52*a* having thirty-two teeth and a gear 52*b* having sixteen teeth, both having a common rotating shaft. The second driving gear 53 is fixed to the rotation shaft of the rotating member 29*c*.

In the arrangement depicted in FIG. 5, the first driving gear 50 driven by a driving motor (not shown) is engaged with the gear 51*b* of the first two-stage gear 51. The gear 51*a* rotated with the gear 51*b* is engaged with the gear 52*b* of the second two-stage gear 52. The gear 52*a* rotated with the gear 52*b* is engaged with the second driving gear 53. The rotation of the development sleeve 24 is thereby reduced to one-eighth and is transmitted to the rotating member 29*c*.

The above-described reduction gear mechanism requires a certain driving torque when it is driven. Therefore, when the feather-like portion 29*a* is located at the closed position at the opening 28*a*, that is, the printer apparatus is not in use yet, the reduction gear mechanism functions to stop movement of the feather-like portion 29*a* by vibrations during transportation, etc. In this way, it is made sure that the opening 28*a* is closed by the feather-like portion 29*a* until the printer apparatus is used.

As an alternative to the reduction gear mechanism, a gear mechanism can be used for transmitting the rotation of the rotating member 29*c* the development sleeve 24 with an increase of the speed. In this case, the rotating member 29*c* is rotated by a driving motor (not shown) and the rotation of the rotating member 29*c* is transmitted by the gear mechanism in accordance with a predetermined increasing ration of rotation speed.

After the feather-like portion 29*a* is moved to release the opening 28*a*, the toner T is supplied from the toner hopper 28 to the development agent 23 carried on the development sleeve 24.

When the feather-like portion 29*a* is rotated, it has pressure exerted upon it by the toner T such that a radius of rotation of the feather-like portion 29*a* is decreased. Therefore, as shown in FIG. 4, the feather-like portion 29*a* is bent to an extent such as not to touch the inner surface of the toner hopper 28 when the toner hopper 28 contains more than a predetermined amount of the toner T. Thereby, the opening 28*a* is not closed again by the feather-like portion 29*a* and is kept open once the development unit 2 is operated when the feather-like portion 29*a* is rotated under the conditions that the toner hopper 28 contains more than the predetermined amount of the toner T. Moreover, since the feather-like portion 29*a* is rotated without touching the inner surface of the toner hopper 28 when the toner hopper 28 contains more than the predetermined amount of the toner T, the feather-like portion 29*a* is prevented from an increase of a torque load which may be increased when the feather-like portion 29*a* touches the inner surface of the toner hopper 28 and thereby the driving torque of the rotation member 29*c* is reduced.

The feather-like portion 29*a* should have sufficient flexibility in order to achieve the above operation. In an example, the feather-like portion is made of Mylar having a thickness of 1 mm or smaller or of a PET film having a thickness of 0.75 mm or smaller. In addition, the feather-like portion 29*a* should also have a stiffness to an extent so as to be able to agitate the toner T in the toner hopper 28.

As described above, in the development unit 2, the opening 28*a* of the toner hopper 28 is sealed by the arrangement in that the feather-like portion 29*a* is located at the position to close the opening 28*a* until the development agent 23 is present on the surface of the development sleeve 24 which in turn faces the opening 28*a*. Thereby, the toner T is prevented from leaking through the opening 28*a*. Further, the rotation of the development sleeve 24 is transmitted to the rotation member 29*c* via the reduction gear mechanism that reduces the number of revolutions per unit time for the rotating member 29*c* to a number smaller than that of the development sleeve 24. Thereby, the development sleeve 24 is caused to begin its rotation and holds the development agent 23 on its surface in turn facing the opening 28*a* before the feather-like portion 29*a* is moved to release the opening 28*a*. Accordingly, when the development unit 2 is initially used, the toner T cannot be attached to a surface of the development sleeve 24 where the development agent 23 is not present. This prevents the development sleeve 24 from having a portion with excess toner density in the development agent 23. As a result, the development unit 2 can perform a superior development operation.

In the development unit 2, no extra component for sealing the opening 28*a* is needed since the feather-like portion 29*a* of the toner agitator 29 is used as a member for sealing the opening 28*a*. Thus, the development sleeve 24 is prevented from the deposition of the toner T, particularly to the surface where the development agent 23 is not present when the development unit 2 is initially used, with a simple structure and a relatively low manufacturing cost.

Further, the sealing of the opening 28*a* can be made reliable and secure by locating the feather-like portion 29*a* at the sealing position with the stopper 46.

Figure 6:
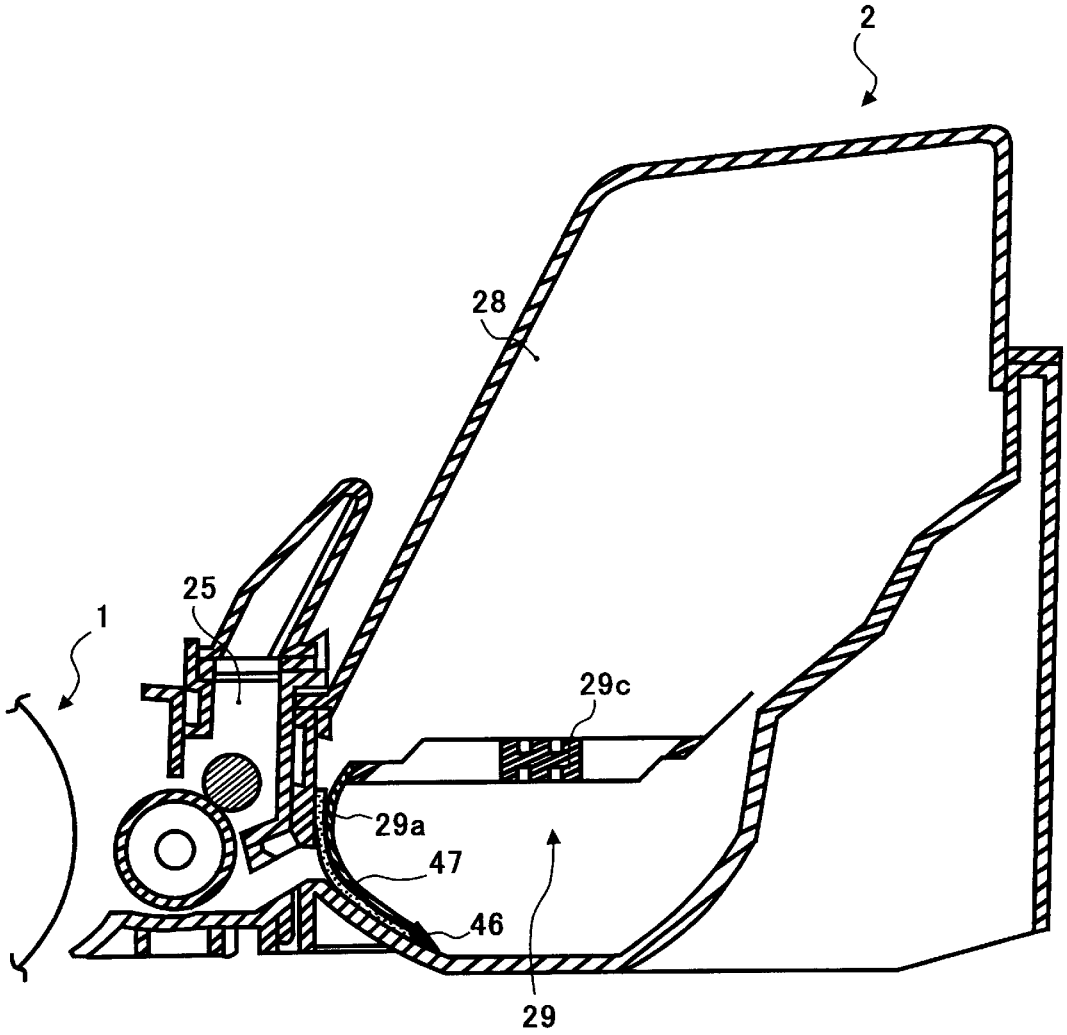
FIG. 6 is a schematic diagram of the development apparatus having a modified feather-like member.

As depicted in FIG. 6, the opening 28*a* can be provided with an elastic member 47 made of sponge around a circumferential edge of the opening 28*a* where the feather-like portion 29*a* touches to seal the opening 28*a*. Thereby, the sealing of the opening 28*a* is made in a more reliable and secure-manner.

As described above, the development unit 2 has a structure in which the number of revolutions per unit time for the development sleeve 24 is greater than that for the feather-like portion 29*a*, and in which the development sleeve 24 and the feather-like portion 29*a* begin rotating at the same time. Therefore, the feather-like portion 29*a* is moved to release the opening 28*a* of the toner hopper 28 after the development agent 23 is present on the surface of the development sleeve 24 which in turn faces the opening 28*a*. However, the development unit 2 can have alternative structure in which, for example, the initial rotation of the feather-like portion 29*a* is delayed from the initial rotation of the development sleeve 24. More specifically, a clutch (not shown) may be provided in conjunction with the toner agitator 29. The clutch stops rotation of the toner agitator 29 for a predetermined time period from the time that the development sleeve 24 starts to rotate. With this structure, when the development sleeve 24 starts to rotate after capturing the development agent 23, the clutch stops rotation of the toner agitator 29 for the predetermined time period. The toner agitator 29 is released from the clutch and starts rotation when the development agent 23 is present on the surface of the development sleeve 24 in turn facing the opening 28*a*. Then, the feather-like portion 29*a* of the toner agitator 29 is moved to release the opening 28*a* and consequently the toner T is started to be supplied to the development sleeve 24.

Figure 7:
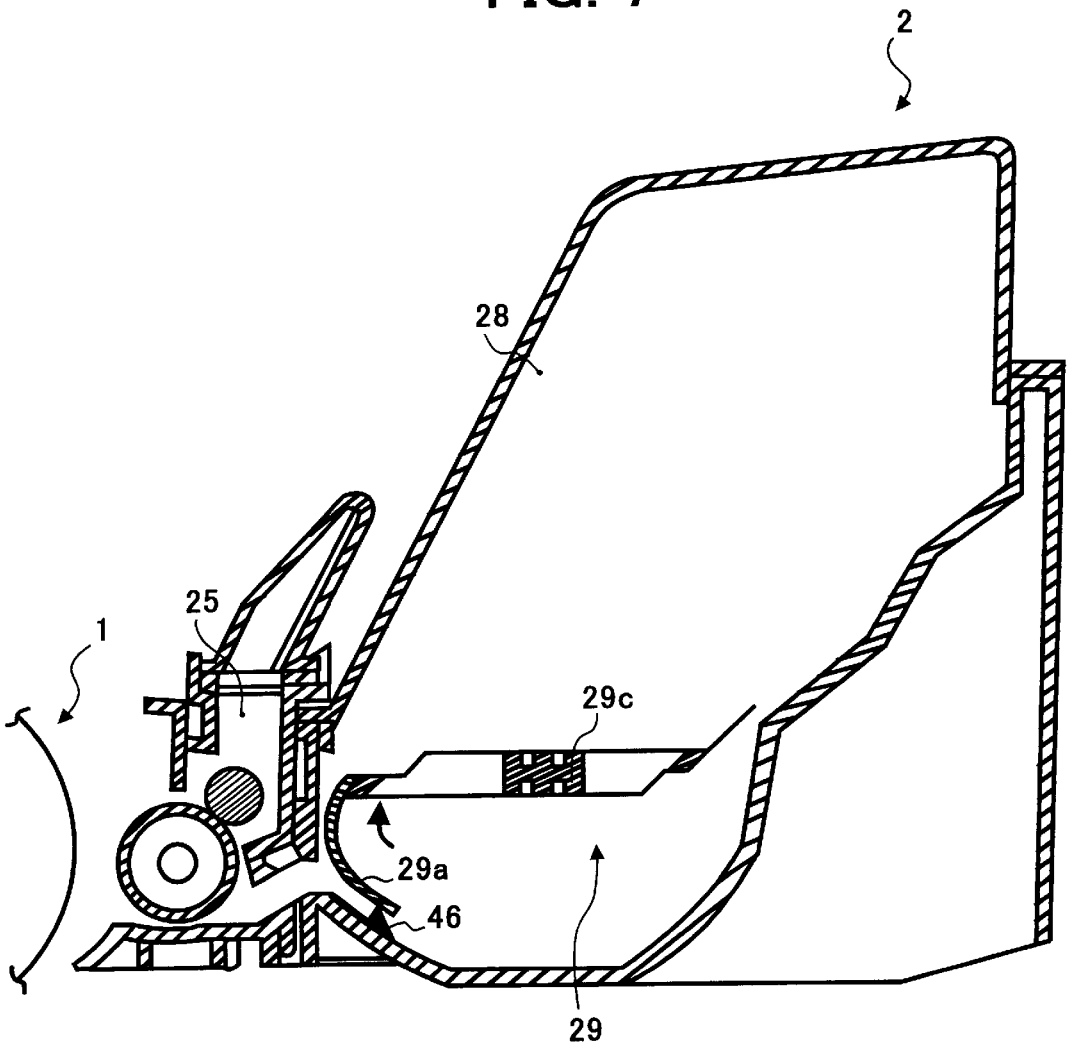
FIGS. 7 and 8 are schematic diagrams for explaining a process of filling the toner into the toner hopper of the development apparatus of FIG. 2.
Figure 8:
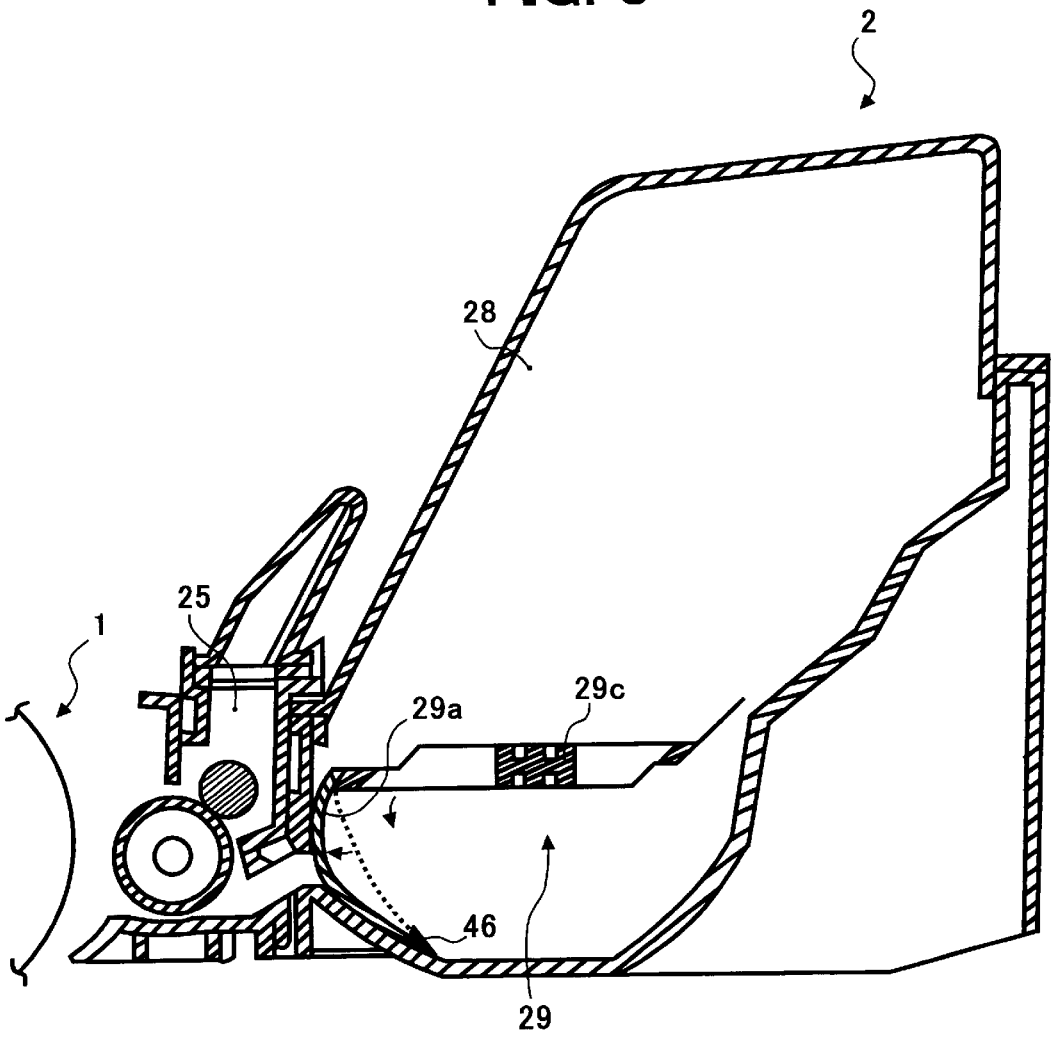

Referring to FIGS. 7 and 8, a process for filling the toner T to the toner hopper 28 of the development unit 2 is explained. As shown in FIG. 7, the feather-like portion 29*a* is first turned clockwise towards the position where the feather-like portion 29*a* seals the opening 28*a* and, during this turn, the feather-like portion 29*a* is lifted up by the stopper 46 and is lowered again when it passes over the stopper 46. The positioning of the feather-like portion 29*a* once the feather-like portion 29*a* is positioned beyond the stopper 46 is shown by a dotted line in FIG. 8.

After passing the stopper 46, the feather-like portion 29*a* is turned counterclockwise in FIG. 8 by a predetermined angular degree so that the top edge of the feather-like portion 29*a* is engaged with the stopper 46. This engagement stops further counterclockwise turning of the feather-like portion 29*a*. Under this condition, a driving torque is applied to the toner agitator 29 to further turn the feather-like portion 29*a* for another predetermined degree of angle. This causes the feather-like portion 29*a* to be bent so that the feather-like portion 29*a* is accurately located at the position for sealing the opening 28*a*. Thereby, the feather-like portion 29*a* closely contacts the circumferential edge of the opening 28*a* which is therefore sealed. Then, the toner T is filled into the toner hopper 28.

In the manner described above, the development sleeve 24 is prevented during an initial operation from depositing toner T, in particular, to a surface thereof where the development agent 23 is not present, using a simple structure and a relatively low manufacturing cost. In addition, the opening 28*a* is perfectly sealed until the development agent 23 is present on the surface of the development sleeve 24 which in turn faces the opening 28*a*.

After the positioning of the feather-like portion 29*a* in the above-described way, gears of the reduction gear mechanism are connected. With this mechanism, the present invention ensures that the feather-like portion 29*a* is held at the position to seal the opening 28*a* during the time that the development unit 2 is not initiated for the operation at a user site, that is, the printer apparatus is in an initially-unused condition. That is, the reduction gear mechanism functions as a mechanism for holding the feather-like portion 29*a* at the closed position to close the opening 28*a* during a time when the printer apparatus is in an initially-unused condition.

Obviously, numerous additional modifications and variations of the present invention are possible in light of the above teachings. It is therefore to be understood that within the scope of the appended claims, the present invention may be practiced otherwise than as specifically described herein.

This document is based on Japanese patent applications, No. JPAP2000-212495 filed on Jul. 13, 2000 in the Japanese Patent Office, the entire contents of which are incorporated by reference herein.

What is claimed as new and is desired to be secure by Letters Patent of the United States is:

1. A development apparatus, comprising:

a development agent carrying member adapted to carry a development agent;

a toner container adapted to contain toner, said toner container including an opening through which the toner is supplied to said development agent carrying member, said opening located at a position facing said development agent carrying member;

a flexible member arranged inside said toner container near said opening, said flexible member being configured to rotate to cyclically transfer the toner to said development agent carrying member via said opening; and a stopper mounted to said toner container at a stop position such that said stopper is engaged with an edge of said flexible member to locate said flexible member at a closed position where said opening is closed by said flexible member.

2. An image forming apparatus, comprising:

a development apparatus comprising:

a development agent carrying member adapted to carry a development agent;

a toner container adapted to contain toner, said toner container including an opening through which the toner is supplied to said development agent carrying member, said opening located at a position facing said development agent carrying member;

a flexible member arranged inside said toner container, said flexible member being configured to rotate to cyclically transfer the toner to said development agent carrying member via said opening; and a stopper mounted to said toner container at a stop position such that said stopper is engaged with an edge of said flexible member to locate said flexible member at a closed position where said opening is closed by said flexible member.

3. An image forming apparatus, comprising:

a development apparatus comprising:

a development agent carrying member adapted to carry a development agent including toner and magnetic carriers, said development agent carrying member including an inner magnetic field generating mechanism;

a toner container adapted to contain toner, said toner container including an opening through which the toner is supplied to said development agent carrying member, said opening located at a position facing said development agent carrying member;

an initial development agent container adapted to contain an initial development agent including at least magnetic carriers, said initial development agent container being sealed when said apparatus is in an initially-unused condition, said initial development agent container including a mechanism for supply said initial development agent to said development agent carrying member when said apparatus is initially used;

a flexible member arranged inside said toner container, said flexible member being configured to rotate to cyclically transfer the toner to said development agent carrying member via said opening; and a stopper mounted to said toner container at a stop position such that said stopper is engaged with an edge of said flexible member to locate said flexible member at a closed position where said opening is closed by said flexible member, wherein said flexible member is initially located at said closed position and is caused to release said opening when the development agent is present on a surface of said development agent carrying member which in turn faces said opening after said development agent carrying member is caused to start rotation.

4. A development apparatus, comprising:

development agent carrying means for carrying a development agent;

toner containing means for containing toner, the toner containing means including an opening through which the toner is supplied to said development agent carrying means, said opening located at a position facing said development agent carrying means;

flexible means arranged inside said toner container, said flexible means being rotatable for cyclically transferring the toner to said development agent carrying means via said opening; and stopping means mounted to the toner containing means at a stop position, said stopping means being for engaging an edge of said flexible means to locate said flexible means at a closed position where said opening is closed by said flexible means.

5. An image forming apparatus, comprising:

a development apparatus comprising:

development agent carrying means for carrying a development agent;

toner containing means for containing toner, said toner containing means including an opening through which the toner is supplied to said development agent carrying means, said opening located at a position facing said development agent carrying means;

flexible means arranged inside said toner container, said flexible means being rotatable for cyclically transferring the toner to said development agent carrying means via said opening; and stopping means mounted to said toner containing means at a stop position, said stopping means being for engaging an edge of said flexible means to locate said flexible means at a closed position where said opening is closed by said flexible means.

6. An image forming apparatus, comprising:

a development apparatus comprising:

development agent carrying means for carrying a development agent including toner and magnetic carriers, said development agent carrying means including an inner magnetic field generating mechanism;

toner containing means for containing toner, the toner containing means including an opening through which the toner is supplied to said development agent carrying means, said opening located at a position facing said development agent carrying means;

initial development agent containing means for containing an initial development agent including at least magnetic carriers and to be sealed when said apparatus is in an initially-unused condition, said initial development agent containing means including a mechanism for supply said initial development agent to said development agent carrying means when said apparatus is initially used;

flexible means arranged inside said toner container, said flexible means being rotatable for cyclically transferring the toner to said development agent carrying means via said opening; and stopping means mounted to said toner containing means at a stop position, said stopping means being for engaging an edge of said flexible means to locate said flexible means at a closed position where said opening is closed by said flexible means, wherein said flexible means is initially located at said closed position and is caused to release said opening when the development agent is present on a surface of said development agent carrying means which in turn faces said opening after said development agent carrying means is caused to start rotation.

7. A development apparatus, comprising:

a development agent carrying member adapted to carry a development agent including toner and magnetic carriers, said development agent carrying member including an inner magnetic field generating mechanism;

a toner container adapted to contain toner, said toner container including an opening through which the toner is supplied to said development agent carrying member, said opening located at a position facing said development agent carrying member;

an initial development agent container adapted to contain an initial development agent including at least magnetic carriers, said initial development agent container being sealed when said apparatus is in an initially-unused condition, said initial development agent container including a mechanism for supply the initial development agent to said development agent carrying member when said apparatus is initially used;

a flexible member arranged inside said toner container near said opening, said flexible member being configured to rotate to cyclically transfer the toner to said development agent carrying member via said opening; and a stopper mounted to said toner container at a stop position such that said stopper is engaged with an edge of said flexible member to locate said flexible member at a closed position where said opening is closed by said flexible member, wherein said flexible member is initially located at said closed position and is caused to release said opening when the development agent is present on a surface of said development agent carrying member which in turn faces said opening after said development agent carrying member is caused to start rotation.

8. A development apparatus as defined in claim 7, further comprising a holding mechanism configured to hold said flexible member at said closed position.

9. A development apparatus as defined in claim 8, wherein said holding mechanism is configured to transmit rotation of said development agent carrying member to said flexible member.

10. A development apparatus as defined in claim 8, wherein said holding mechanism is configured to transmit rotation of said flexible member to said development agent carrying member.

11. A development apparatus as defined in claim 7, further comprising an elastic member fixed to a circumferential edge of said opening of said toner container, where said flexible member contacts in said closed position.

12. A development apparatus as defined in claim 7, wherein said flexible member has a flexibility such that said flexible member bends under a pressure from the toner, while the flexible member is rotating, to an extent that said flexible member does not touch an inner surface of said toner container when said toner container contains more than a predetermined amount of the toner.

13. A development apparatus as defined in claim 7, wherein the toner supplied through said opening of said toner container is captured by the development agent carried on said development agent carrying member in accordance with a toner density of the development agent carried on said development agent carrying member.

14. A development apparatus, comprising:

development agent carrying means for carrying a development agent including toner and magnetic carriers, said development agent carrying means including an inner magnetic field generating mechanism;

toner containing means for containing toner, said toner containing means including an opening through which the toner is supplied to said development agent carrying means, said opening located at a position facing said development agent carrying means;

initial development agent containing means for containing an initial development agent including at least magnetic carriers, said initial development agent containing means being sealed when said apparatus is in an initially-unused condition, said initial development agent containing means including a mechanism for supplying the initial development agent to said development agent carrying means when said apparatus is initially used;

flexible means arranged inside said toner containing means, said flexible means being rotatable for cyclically transferring the toner to said development agent carrying means via said opening; and stopping means mounted to said toner containing means at a stop position, said stopping means being for engaging an edge of said flexible means to locate said flexible means at a closed position where said opening is closed by said flexible means, wherein said flexible means is initially located at said closed position and is caused to release said opening when said development agent is present on a surface of said development agent carrying means which in turn faces said opening after said development agent carrying means is caused to start rotation.

15. A development apparatus as defined in claim 14, further comprising holding means for holding said flexible means at said closed position.

16. A development apparatus as defined in claim 15, wherein said holding means transmits rotation of said development agent carrying means to said flexible means.

17. A development apparatus as defined in claim 15, wherein said holding means transmits rotation of said flexible means to said development agent carrying means.

18. A development apparatus as defined in claim 14, further comprising elastic means fixed to a circumferential edge of said opening of the toner containing means, where said flexible means contacts in said closed position.

19. A development apparatus as defined in claim 14, wherein said flexible means has a flexibility such that said flexible means, bends under a pressure from the toner, while the flexible means is rotating, to an extent that said flexible means does not touch an inner surface of said toner containing means when said toner containing means contains more than a predetermined amount of the toner.

20. A development apparatus as defined in claim 14, wherein the toner supplied through said opening of said toner containing means is captured by the development agent carried on said development agent carrying means in accordance with a toner density of the development agent carried on said development agent carrying means.

21. A method of image forming, comprising the steps of:

sealing an opening of a toner container for containing toner by engaging a flexible member with a stopper mounted to said toner container at a stop position such that said stopper is engaged with an edge of said flexible member to locate said flexible member at a closed position where said opening is closed by said flexible member;

filling said toner container with the toner;

supplying a development agent including at least magnetic carriers to a development agent carrying member at a surface of said development agent facing said opening of said toner container; and releasing said opening to start supplying the toner to said development agent carrying member through said opening by rotation of said flexible member.

22. A method as defined in claim 21, further comprising a holding step for holding said flexible member at said closed position.

23. A method as defined in claim 22, wherein a movement of said development agent carrying member is transmitted to said flexible member.

24. A method as defined in claim 22, wherein a movement of said flexible member is transmitted to said development agent carrying member.

25. A method as defined in claim 21, further comprising a step of fixing an elastic member to a circumferential edge of said opening of the toner containing member, where said flexible member contacts in said closed position.

26. A method as defined in claim 21, wherein the toner supplied through said opening of said toner container is captured by the development agent carried on said development agent carrying member in accordance with a toner density of the development agent carried on said development agent carrying member.

27. A method of image forming, comprising the steps of:

sealing an opening of a toner container for containing toner by engaging a flexible member with a stopper;

filling said toner container with the toner;

supplying a development agent including at least magnetic carriers to a development agent carrying member at a surface of said development agent facing said opening of said toner container; and releasing said opening to start supplying the toner to said development agent carrying member through said opening by rotation of said flexible member, wherein said flexible member has a flexibility such that said flexible member bends under a pressure from the toner, while the flexible member is rotating, to an extent that said flexible member does not touch an inner surface of said toner container when said toner container contains more than a predetermined amount of toner.

28. A method of image forming, comprising the steps of:

sealing an opening of a toner container for containing toner by engaging a flexible member with a stopper;

filling said toner container with the toner;

supplying a development agent including at least magnetic carriers to a development agent carrying member at a surface of said development agent facing said opening of said toner container; and releasing said opening to start supplying the toner to said development agent carrying member through said opening by rotation of said flexible member, wherein said releasing step comprises:

rotating said flexible member;

causing said flexible member to be lifted up by said stopper;

lowering said flexible member from said stopper;

reversing a rotational direction of said flexible member by a predetermined angular degree to engage with said stopper; and applying a reversing force to said flexible member for turning said flexible member by another predetermined angular degree.

* * * * *